US010202932B2

(12) United States Patent
Doho et al.

(10) Patent No.: US 10,202,932 B2
(45) Date of Patent: Feb. 12, 2019

(54) ENGINE COOLING STRUCTURE

(71) Applicant: MAZDA MOTOR CORPORATION, Hiroshima (JP)

(72) Inventors: Masanori Doho, Hiroshima (JP); Yoshiaki Hayamizu, Higashihiroshima (JP); Jun Nakashima, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/119,842

(22) PCT Filed: Feb. 23, 2015

(86) PCT No.: PCT/JP2015/000869

§ 371 (c)(1),
(2) Date: Aug. 18, 2016

(87) PCT Pub. No.: WO2015/145961

PCT Pub. Date: Oct. 1, 2015

(65) Prior Publication Data

US 2017/0067411 A1 Mar. 9, 2017

(30) Foreign Application Priority Data

Mar. 28, 2014 (JP) ..... 2014-069178

(51) Int. Cl.
*F02F 1/10* (2006.01)
*F02F 1/00* (2006.01)
(Continued)

(52) U.S. Cl.
CPC ..... *F02F 1/10* (2013.01); *F01P 3/02* (2013.01); *F02F 1/004* (2013.01); *F02F 1/14* (2013.01);
(Continued)

(58) Field of Classification Search
CPC ..... F02F 1/10; F02F 1/14; F02F 1/004; F02F 2001/104; F01P 3/02; F01P 2003/024
See application file for complete search history.

(56) References Cited

U.S. PATENT DOCUMENTS 7,216,611 B2 * 5/2007 Matsutani ..... F02F 1/14 123/198 E
8,171,896 B2 * 5/2012 Hanai ..... F02F 1/16 123/41.28
(Continued)

FOREIGN PATENT DOCUMENTS

JP 55-066612 A 5/1980
JP 60-164645 U 11/1985
(Continued)

OTHER PUBLICATIONS

International Search Report issued in PCT/JP2015/000869; dated May 19, 2015.
Written Opinion issued in PCT/JP2015/000869; dated May 19, 2015.

*Primary Examiner* — Joseph J Dallo
*Assistant Examiner* — Kurt Philip Liethen
(74) *Attorney, Agent, or Firm* — Studebaker & Brackett PC

(57) ABSTRACT

A water jacket spacer is arranged to surround substantially an entire periphery of a portion of the cylinder liner which corresponds to the water jacket. An opening through which a coolant introduced from a coolant-introducing section is introduced to an inner side of a water jacket spacer is formed in a portion of the water jacket spacer which corresponds to the coolant-introducing section. An upper section of the water jacket spacer is positioned close to a cylinder block outer peripheral wall. A coolant passage through which the coolant introduced from the opening is circulated around an outer periphery of an upper portion of the cylinder liner is
(Continued)

formed between the upper section of the water jacket spacer and the outer periphery of the upper portion of the cylinder liner. A lower section of the water jacket spacer is positioned close to the cylinder liner.

15 Claims, 9 Drawing Sheets

(51) Int. Cl.
*F01P 3/02* (2006.01)
*F02F 1/14* (2006.01)

(52) U.S. Cl.
CPC ... *F01P 2003/024* (2013.01); *F02F 2001/104* (2013.01)

(56) References Cited

U.S. PATENT DOCUMENTS

2002/0000210 A1* 1/2002 Shinpo ..... F01P 3/02 123/41.74
2005/0217614 A1 10/2005 Matsutani et al.
2005/0217615 A1 10/2005 Matsutani et al.
2009/0194046 A1 8/2009 Shikida et al.
2011/0114043 A1* 5/2011 Hamakawa ..... F02F 1/14 123/41.74
2012/0132157 A1* 5/2012 Matsuki ..... F02F 1/14 123/41.79
2017/0022929 A1* 1/2017 Karita ..... F02F 1/14

FOREIGN PATENT DOCUMENTS

JP 7-224651 A 8/1995
JP 2001-020738 A 1/2001
JP 2002-030989 A 1/2002
JP 2003-262155 A 9/2003
JP 2005-120944 A 5/2005
JP 2005-256660 A 9/2005
JP 2005-291013 A 10/2005
JP 2006-090197 A 4/2006
JP 2007-071039 A 3/2007
JP 2008-031939 A 2/2008
JP 4279713 B2 6/2009
JP 2009-243414 A 10/2009
JP 2010-014067 A 1/2010
JP 2011-064142 A 3/2011

* cited by examiner

ENGINE COOLING STRUCTURE

TECHNICAL FIELD

A technique disclosed herein relates to an engine cooling structure, and in particular, to an engine cooling structure in which a water jacket spacer for forming a passage for cooling water is arranged in a water jacket of a cylinder block.

BACKGROUND ART

An engine cooling structure has been known in which a water jacket through which cooling water flows is formed in a cylinder block that forms part of an engine, and a water jacket spacer for forming a passage for the cooling water is arranged in the water jacket. An example of this known engine cooling structure is disclosed in Patent Document 1.

In the engine cooling structure disclosed in Patent Document 1, a water jacket spacer which covers substantially the entirety of the outer periphery of cylinder liners is arranged in a water jacket, and a notch is cut in an upper portion of the water jacket spacer, thereby forming a space for increasing the flow rate of the cooling water that flows along the outer periphery of the cylinder liners. In this engine cooling structure, the cooling water is circulated along the inner and outer sides of the water jacket spacer.

CITATION LIST

Patent Document

Patent Document 1: Japanese Patent No. 4279713

SUMMARY OF THE INVENTION

Technical Problem

However, in the engine cooling structure disclosed in Patent Document 1, since the cooling water in the water jacket flows along the outer side of the water jacket spacer, the heat of the cylinder liners is dissipated, via the cooling water, to the cylinder block outer peripheral wall that constitutes the outer periphery of the water jacket. Consequently, the cylinder liners are heated less effectively, and it takes time to make the temperature distribution of the entire cylinder liner substantially uniform. Therefore, sliding resistance of the pistons that slide inside the cylinder liner is not easily reduced, and the engine is less effectively warmed up. In addition, the upper portions of the cylinder liners that are near combustion chambers are cooled less effectively.

The technique disclosed herein has been developed in view of the foregoing, and some of the objects of the technique are to reduce heat dissipation to a cylinder block outer peripheral wall, to achieve fast and uniform heating of a cylinder liner, and to ensure cooling of an upper portion of the cylinder liner.

Solution to the Problem

To achieve the above objects, according to the technique disclosed herein, an upper section of a water jacket spacer is positioned close to a cylinder block outer peripheral wall, and a coolant passage is formed between the upper section of the water jacket spacer and an outer periphery of an upper portion of a cylinder liner.

Specifically, the technique disclosed herein relates to an engine cooling structure in which a water jacket surrounds a cylinder liner of a cylinder block forming part of an engine, a coolant-introducing section through which a coolant is introduced into the water jacket is formed in a cylinder block outer peripheral wall constituting an outer periphery of the water jacket, and a water jacket spacer is arranged in the water jacket. The technique also provides the following measures.

Specifically, according to the technique disclosed herein, the water jacket spacer is arranged to surround substantially an entire periphery of a portion of the cylinder liner which corresponds to the water jacket, an opening through which the coolant introduced from the coolant-introducing section is introduced to an inner side of the water jacket spacer is formed in a portion of the water jacket spacer which corresponds to the coolant-introducing section, an upper section of the water jacket spacer is positioned close to the cylinder block outer peripheral wall, a coolant passage through which the coolant introduced from the opening is circulated around an outer periphery of an upper portion of the cylinder liner is formed between the upper section of the water jacket spacer and the outer periphery of the upper portion of the cylinder liner, and a lower section of the water jacket spacer is positioned close to the cylinder liner.

With this configuration, since the coolant passage is formed between the upper section of the water jacket spacer and the outer periphery of the upper portion of the cylinder liner, the coolant flowing through the coolant passage is not allowed to come into contact with the cylinder block outer peripheral wall. Further, since the upper section of the water jacket spacer is positioned close to the cylinder block outer peripheral wall, the coolant flowing through the coolant passage is thermally insulated by the water jacket spacer. These features may hinder the heat of the cylinder liner from dissipated to the cylinder block outer peripheral wall via the coolant flowing through the coolant passage. In addition, the lower section of the water jacket spacer is positioned close to a lower portion of the cylinder liner, and the lower portion of the cylinder liner is thermally insulated by the water jacket spacer, which may hinder the lower portion of the cylinder liner from being cooled. Thus, the cylinder liner may be heated within a short time, and uniform temperature distribution may be achieved. As a result, the sliding resistance of pistons may be reduced, and fuel efficiency may be improved. Furthermore, the upper portion of the cylinder liner may be reliably cooled. Moreover, since the coolant flows only through substantially the upper portion of the water jacket, the amount of the coolant may be reduced, and load on a water pump which sends the coolant to the water jacket may be reduced. As a result, the warm-up of the engine may be facilitated.

The coolant passage is beneficially formed by spacing the upper section of the water jacket spacer from the outer periphery of the upper portion of the cylinder liner.

With this configuration, since the coolant passage is formed by spacing the upper section of the water jacket from the outer periphery of the upper portion of the cylinder liner, the coolant passage may be formed without changing the shape of the outer periphery of the upper portion of the cylinder liner.

It is beneficial that: the engine be configured as a multi-cylinder engine including a plurality of cylinders; the cylinder liner comprise a plurality of cylinder liners; the water jacket surround the cylinders each provided in an associated one of the cylinders; the water jacket spacer be made of resin and surround the cylinder liners; and seal members be provided between inter-cylinder bore walls of the cylinder block and portions of the water jacket spacer which correspond to the inter-cylinder bore walls.

With this configuration, while the water jacket spacer of resin is molded, taking into consideration manufacturing errors and mountability, such that large gaps are provided between the spacer and the inter-cylinder bore walls, the seal members are provided in these gaps. This may hinder the coolant flowing through the coolant passage from leaking outside from the coolant passage via the gaps.

The opening is beneficially formed in an end portion of the water jacket spacer in a direction in which the cylinders are aligned; and the coolant passage is beneficially formed such that the coolant introduced from the opening is circulated from an exhaust side portion of the coolant passage to an intake side portion of the coolant passage.

With this configuration, since the coolant is circulated from the exhaust side portion having a relatively high temperature, the cylinder liner of each cylinder may be appropriately cooled.

In a cylinder head which constitutes the engine together with the cylinder block, a cylinder head water jacket through which the coolant from the water jacket of the cylinder block flows is beneficially formed. A coolant-discharging section through which the coolant that has been circulated through the coolant passage is discharged to the cylinder head water jacket is beneficially formed in an end portion of the water jacket spacer in the direction in which the cylinders are aligned. A coolant-restricting section which restricts a flow of the coolant that has been introduced from the opening is beneficially formed between the coolant-discharging section and the opening in the water jacket spacer.

With this configuration, the coolant that has been introduced from the coolant-introducing section enters the coolant passage through the opening, and flows to the exhaust side portion and the intake side portion of the coolant passage. The portion of the coolant flowing to the intake side portion is restricted by the coolant-restricting section. Specifically, the coolant that flows from the opening to the cylinder head water jacket through the coolant-discharging section is restricted by the coolant-restricting section. Therefore, the major portion of the coolant that has flowed through the opening into the coolant passage may be made to flow through the exhaust side portion of the coolant passage and may be reliably circulated through the coolant passage. Then, the coolant may be reliably made to flow into the cylinder head water jacket.

Advantages of the Invention

According to the technique disclosed therein, heat dissipation to the cylinder block outer peripheral wall may be reduced, fast and uniform heating of the cylinder liner may be achieved, and the upper portion of the cylinder liner may be reliably cooled.

DESCRIPTION OF EMBODIMENTS

Exemplary embodiments will be described below in detail with reference to the drawings.

Figure 1:
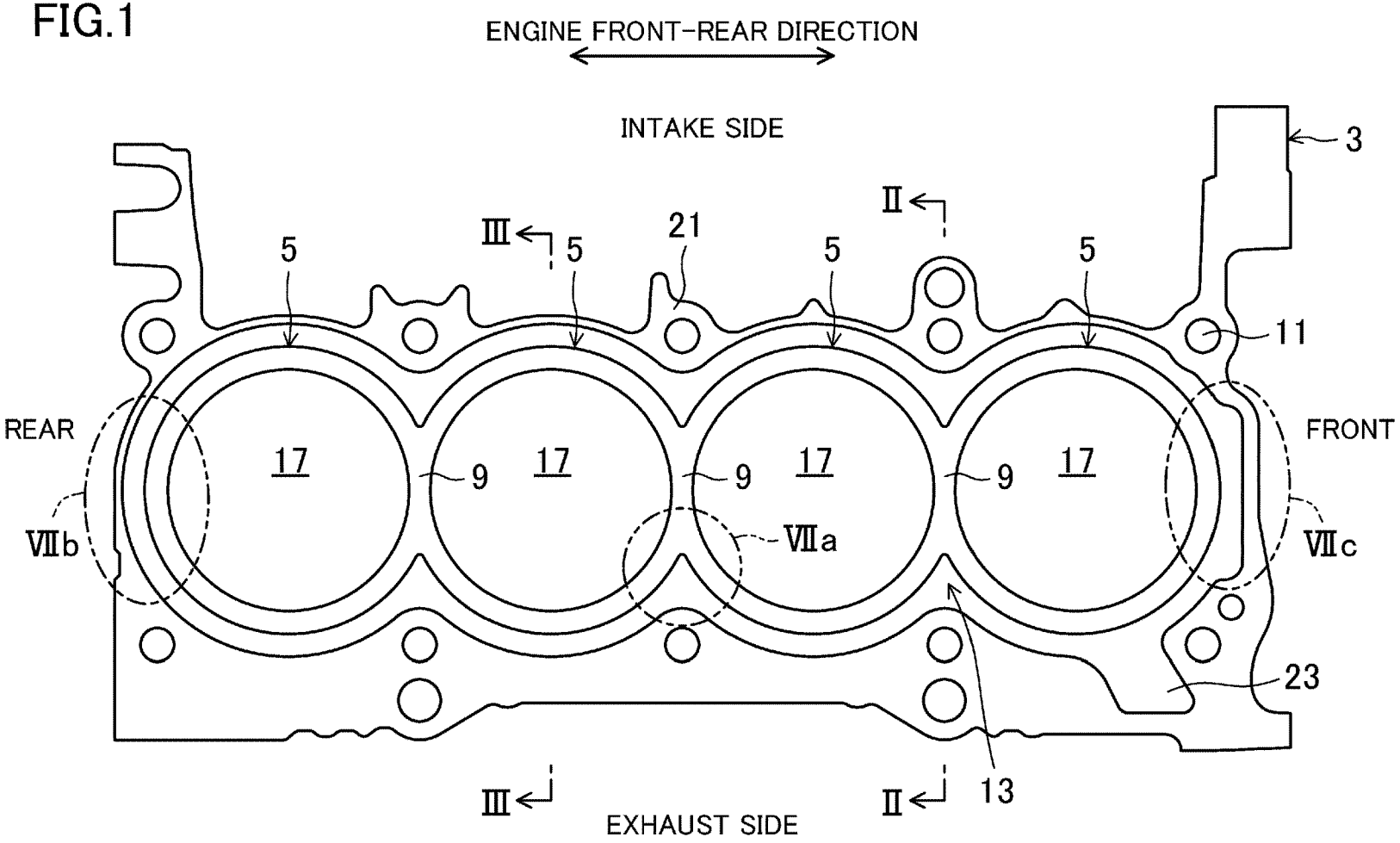
FIG. 1 is a top view of a cylinder block.
Figure 2:
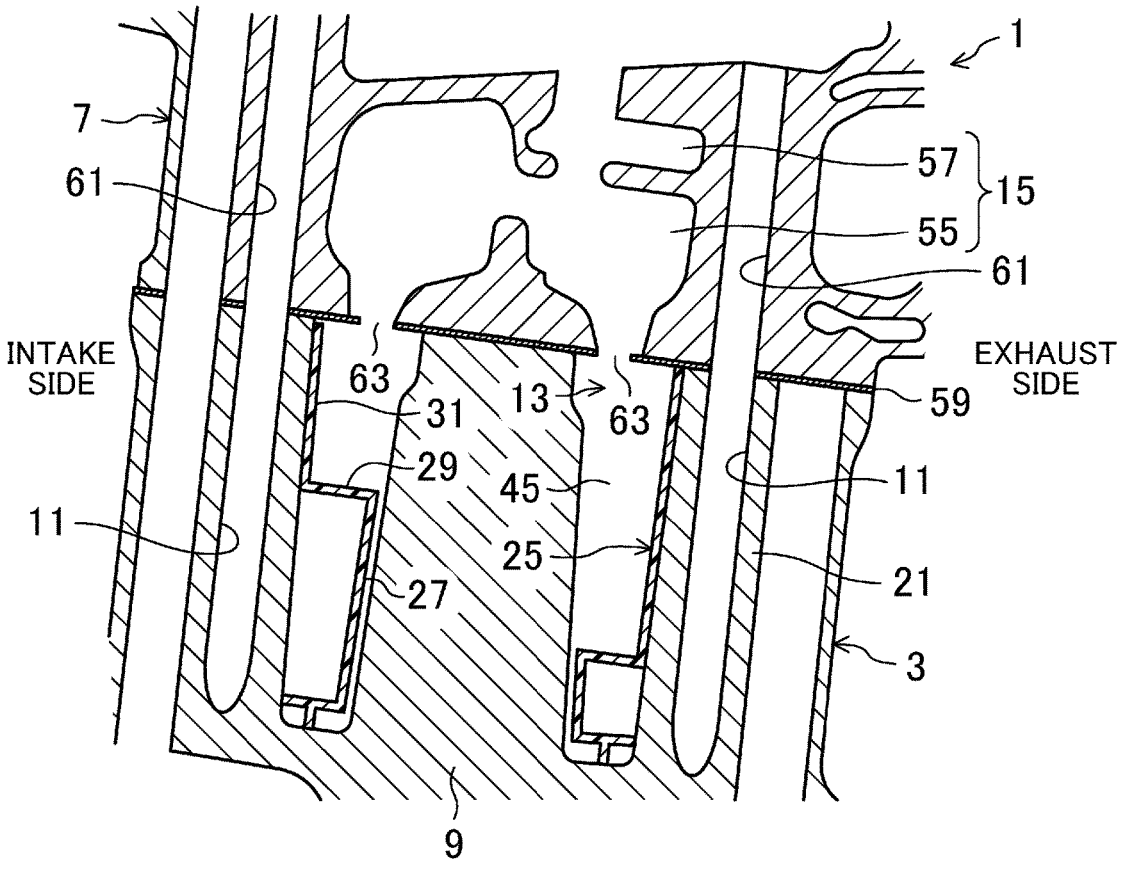
FIG. 2 is a view corresponding to a cross section of an engine, taken along the plane II-II in FIG. 1.
Figure 3:
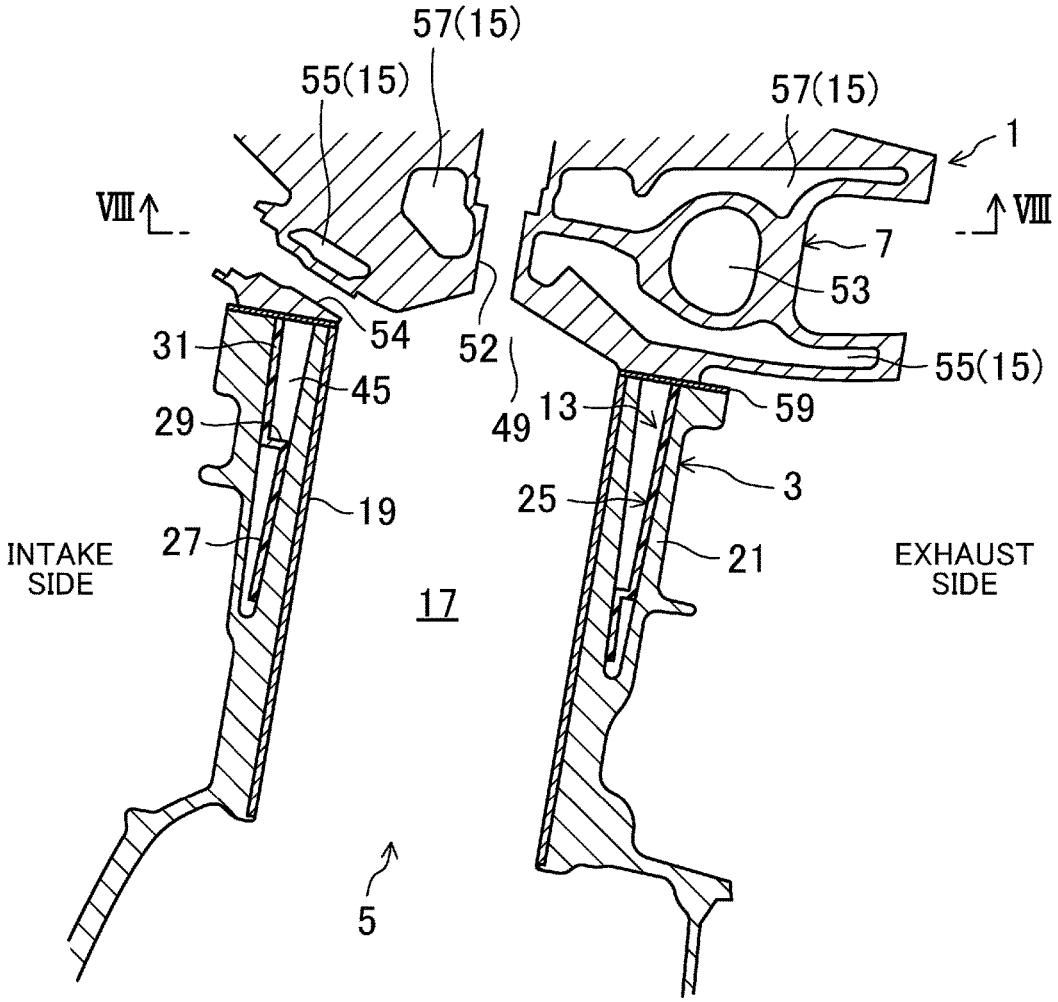
FIG. 3 is a view corresponding to a cross section of the engine, taken along the plane in FIG. 1.

FIG. 1 is a top view of a cylinder block 3 which forms part of a multiple-cylinder engine 1 (hereinafter referred to as the engine 1) having an engine cooling structure according to an exemplary embodiment. FIGS. 2 and 3 show cross sections of the engine 1, taken along the plane II-II and the plane in FIG. 1, respectively.

The engine 1 is an inline four-cylinder engine which includes four Siamese type cylinders 5, 5, . . . arranged in series along the axial direction of a crankshaft (not shown). This engine 1 is comprised of the cylinder block 3 that is made of an aluminum alloy and a cylinder head 7 that is also made of an aluminum alloy and mounted onto the top of the cylinder block 3. The engine 1 is configured such that pistons (not shown) vertically reciprocate in the cylinder 5, 5, . . . that are formed by the cylinder block 3 and the cylinder head 7.

The engine 1 is transversely installed in an engine compartment in a front portion of a vehicle such that the crankshaft extends in the vehicle width direction. More specifically, the installed engine 1 slants such that the centerline of each cylinder 5 is tilted at a predetermined angle with respect to the vertical direction. An intake manifold (not shown) for introducing intake air into each cylinder 5 is arranged on the left side of the engine 1 (i.e., in an upper part of FIG. 1). An exhaust system (such as an exhaust manifold, not shown) is arranged on the right side of the engine 1 (i.e., in a lower part of FIG. 1). This cylinder block 3 has bolt holes 11, 11, . . . into which bolts are screwed to fix the cylinder head 7 to the cylinder block 3. The bolt holes 11, 11, . . . are formed in end portions of the cylinder block 3 in its longitudinal direction (i.e., the direction in which the cylinders are aligned, hereinafter also referred to as the engine front-rear direction) and in the intake and exhaust side portions of each of inter-cylinder bore walls 9, 9, . . . of the cylinder block 3.

The engine 1 is provided with a water pump (not shown) arranged therein to send cooling water into water jackets 13 and 15 formed respectively in the cylinder block 3 and the cylinder head 7, as will be described later. The water pump is driven by the crankshaft via a crank pulley (not shown) provided in the cylinder block 3.

The cylinder block 3 is comprised of a block member which is in a substantially rectangular parallelepiped shape and which has cylinder bores 17, 17, . . . each forming part of an associated one of the cylinders 5, 5, . . . of the engine 1. The cylinder bores 17, 17, . . . are arranged in series and open on the upper face of the cylinder block 3. Further, the cylinder block water jacket 13 (i.e., a water jacket) functioning as a channel for cooling water is formed in the cylinder block 3. The cylinder block water jacket 13 extends along the intake and exhaust sides of the cylinder bores 17, 17, . . . so as to cool the periphery of each of cylinder liners 19 (see FIG. 3) which are arranged on the inner peripheral surfaces of the cylinders 5 (i.e., on the inner peripheral surfaces of the cylinder bores 17). As shown in FIG. 3, the cylinder block water jacket 13 surrounds a portion of each cylinder liner 19 which extends from un upper portion to a middle portion in the vertical direction (i.e., the direction in which the pistons reciprocate). More specifically, the cylinder block water jacket 13 surrounds a portion that extends from the upper end of each cylinder liner 19 and corresponds to about 60% of the vertical length of the cylinder liner 19.

In a top view, the cylinder block water jacket 13 has constrictions in its portions corresponding to the inter-cylinder bore walls 9, 9, . . . . The outer periphery of the cylinder block water jacket 13 is constituted of a cylinder block outer peripheral wall 21 which has, in its engine front end portion facing the exhaust side, a cooling water-introducing passage 23 (i.e., a coolant-introducing section) through which cooling water sent from the water pump is introduced into the cylinder block water jacket 13. The portion of the cylinder block outer peripheral wall 21 where the cooling water-introducing passage 23 is formed corresponds to a portion of the cylinder block water jacket 13 which is below the vertically middle portion of the water jacket 13. The cooling water-introducing passage 23 is tilted toward the rear of the engine as decreasing distance to the cylinder 5 closest to the front of the engine. This causes the cooling water introduced from the cooling water-introducing passage 23 into the cylinder block water jacket 13 to branch off so that the major portion of the cooling water flows toward the rear of the engine and the rest flows toward the front of the engine.

Figure 4:
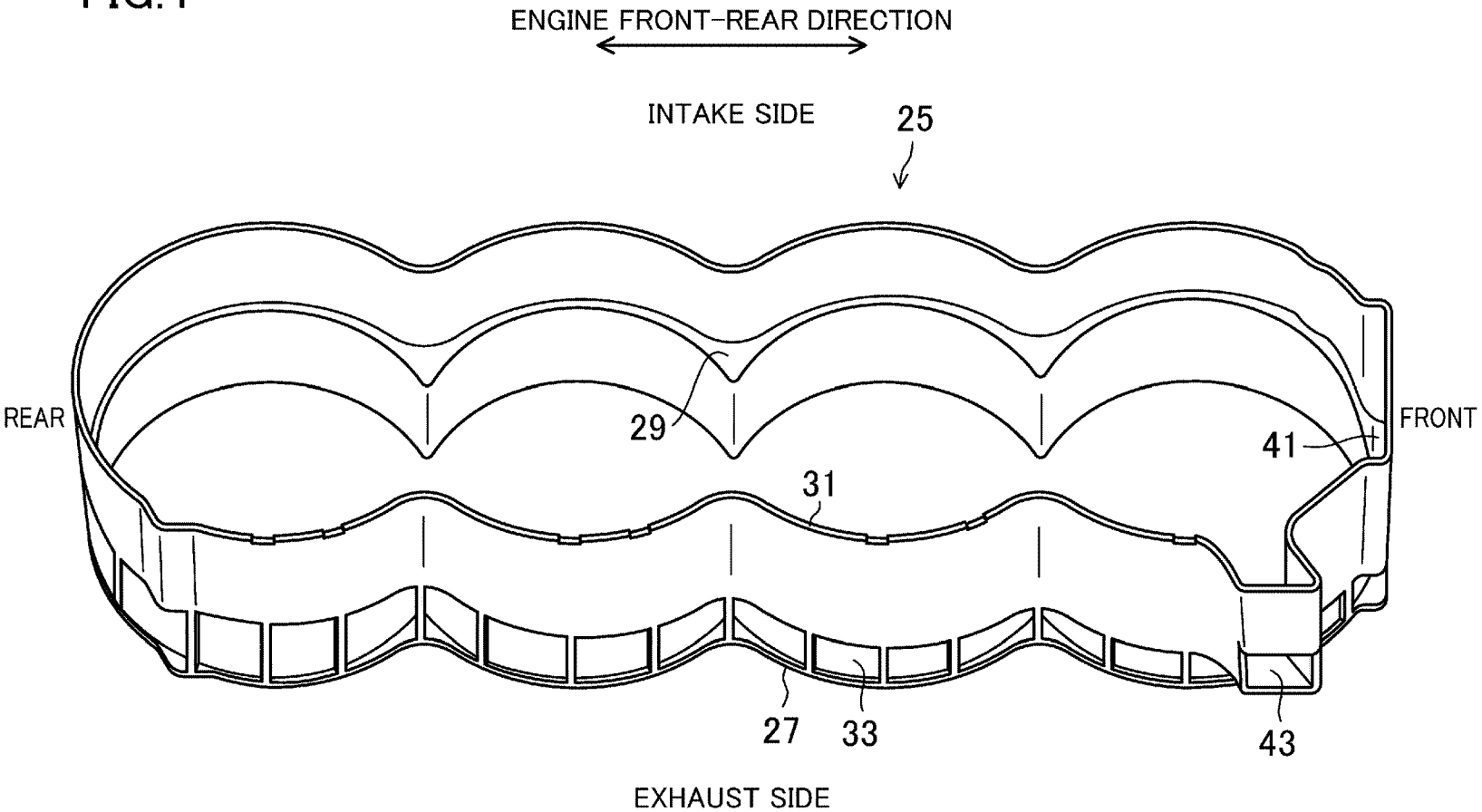
FIG. 4 is a perspective view of a water jacket spacer, as viewed from the exhaust side.
Figure 5:
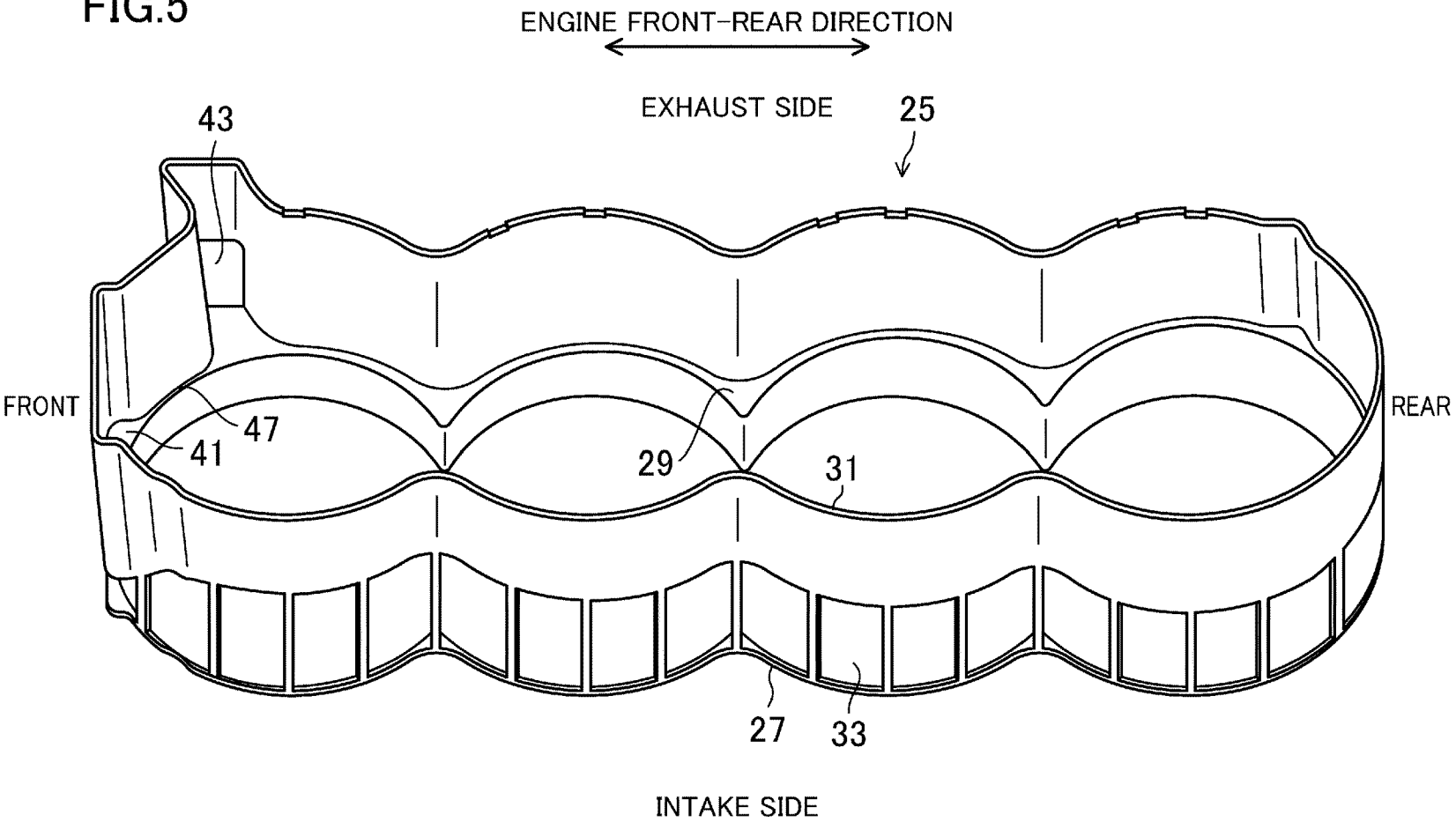
FIG. 5 is a perspective view of the water jacket spacer, as viewed from the intake side.
Figure 6A:
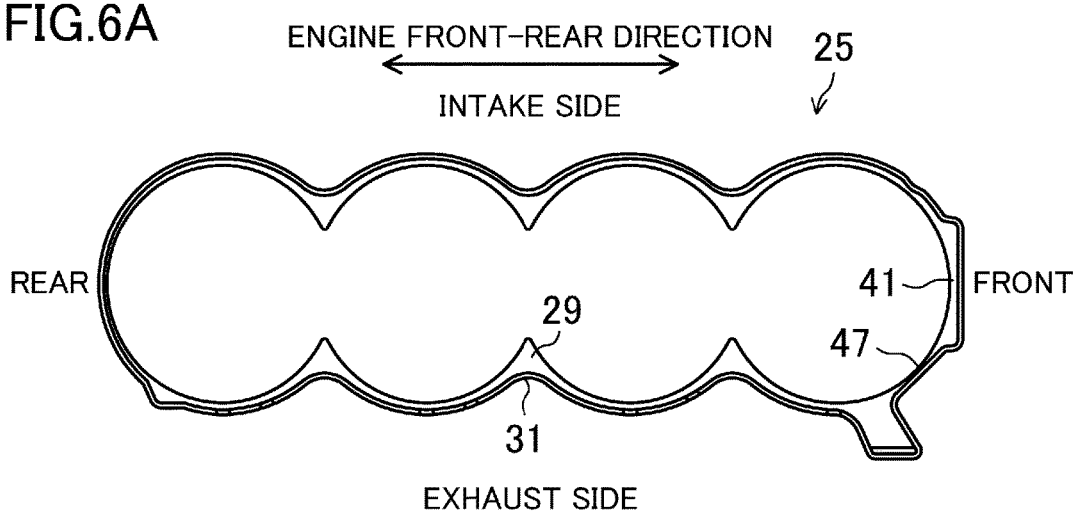
FIG. 6A is a plan view of a water jacket spacer.
Figure 6B:
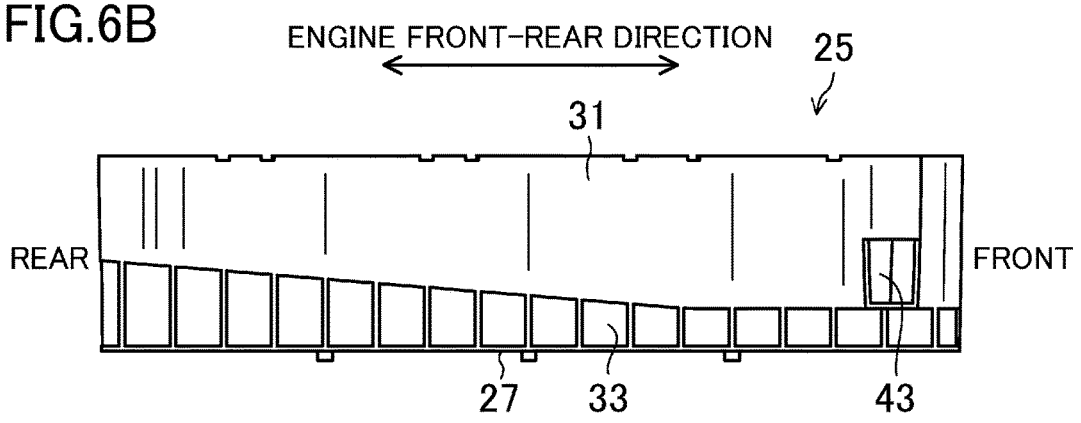
FIG. 6B is a side view of the water jacket spacer, as viewed from the exhaust side.
Figure 6C:
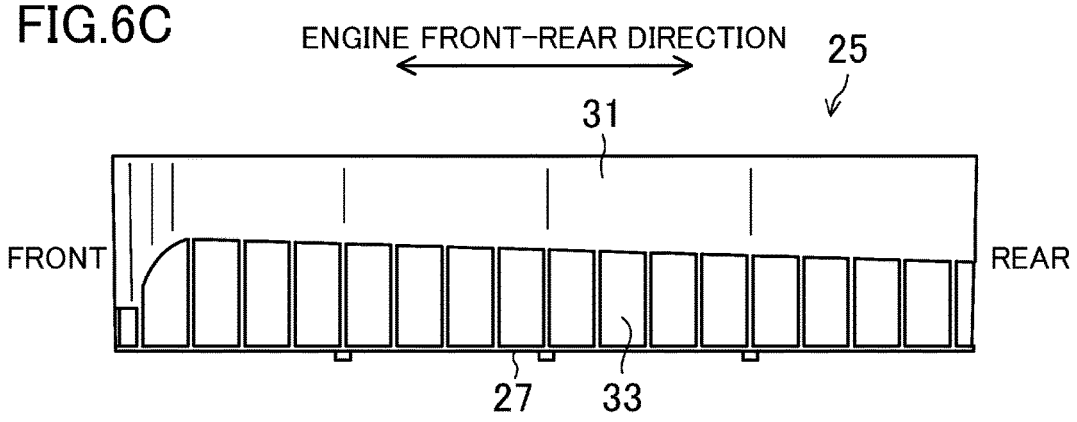
FIG. 6C is a side view of the water jacket spacer, as viewed from the intake side.

In the cylinder block water jacket 13, a water jacket spacer 25 is arranged to form a passage for the cooling water flowing through the cylinder block water jacket 13. The water jacket spacer 25 surrounds substantially the entire periphery of the portion of each of the four cylinder liners 19, 19, . . . which corresponds to the cylinder block water jacket 13. FIGS. 4 and 5 are perspective views of the entire water jacket spacer 25, as viewed from the exhaust side and the intake side, respectively. FIGS. 6A-6C also show the water jacket spacer 25. Specifically, FIG. 6A is a plan view, FIG. 6B is a side view as viewed from the exhaust side, and FIG. 6C is a side view as viewed from the intake side.

The water jacket spacer 25 is made of a heat-resistant synthetic resin. The water jacket spacer 25 has a jacket spacer lower section 27 which surrounds a vertically middle portion of each cylinder liner 19, a flange section 29 which projects outward from the upper end of the jacket spacer lower section 27 toward the cylinder block outer peripheral wall 21, and a jacket spacer upper section 31 which extends upward from the outer peripheral end of the flange section 29 and surrounds the upper end portion of each cylinder liner 19.

The jacket spacer lower section 27 is in a substantially oval cylinder shape oriented in the engine front-rear direction and has, at its portions corresponding to the inter-cylinder bore walls 9, 9, . . . , constrictions in conformity with the shapes of the inter-cylinder bore walls 9, 9, . . . , in a top view.

As shown in FIG. 6B, in an exhaust side portion of the jacket spacer lower section 27, the upper end of a portion corresponding to the cylinder 5 closest to the front of the engine is at a constant height, whereas the upper end of the rest of the exhaust side portion of the jacket spacer lower section 27 is upwardly inclined toward the rear of the engine. As shown in FIG. 6C, the upper end of an intake side portion of the jacket spacer lower section 27 is inclined upward toward the front of the engine more gradually than the upper end of the exhaust side portion.

As shown in FIGS. 4-6C, in order to reduce the weight, lightening recesses 33 are formed in the outer peripheral surface of the jacket spacer lower section 27 at regular intervals in the circumferential direction.

The jacket spacer lower section 27 is positioned close to the vertically middle portion of each cylinder liner 19, and is substantially in contact with the outer peripheral surface of each cylinder 5 positioned outward relative to the associated cylinder liner 19. However, the portions of the jacket spacer lower section 27 that correspond to the inter-cylinder bore walls 9, 9, . . . are positioned slightly outward relative to the inter-cylinder bore walls 9, 9, . . . because the portions of the cylinder block water jacket 13 that correspond to the inter-cylinder bore walls 9, 9, . . . are relatively narrow. Therefore, as shown in FIG. 2, relatively large gaps are formed between the portions of the jacket spacer lower section 27 that correspond to the inter-cylinder bore walls 9, 9, . . . and the inter-cylinder bore walls 9, 9, . . . . Further, in order that the water jacket spacer 25 can be easily mounted to the cylinder block water jacket 13 in the fabrication of the engine 1, the water jacket spacer 25 is designed to have relatively large gaps, one of which is between the water jacket spacer 25 and the outer peripheral surface of the cylinder 5 closest to the front of the engine, and the other of which is between the water jacket spacer 25 and the outer peripheral surface of the cylinder 5 closest to the rear of the engine. These relatively large gaps, however, may cause the cooling water flowing through a cooling water passage 45 which is formed to extend along the inner surface of the jacket spacer upper section 31 (and which will be detailed later) to leak into the space present inward relative to the jacket spacer lower section 27. For this reason, sealing members 35, 37, and 39 made of urethane rubber are arranged in these relatively large gaps.

Figure 7A:
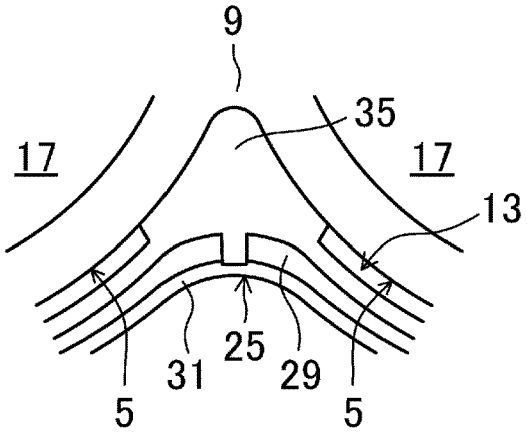
FIG. 7A shows, on an enlarged scale, the portion VIIa in FIG. 1 with the water jacket spacer attached.
Figure 7B:
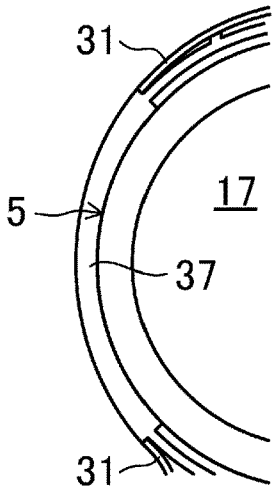
FIG. 7B shows, on an enlarged scale, the portion VIIb in FIG. 1 with the water jacket spacer attached.
Figure 7C:
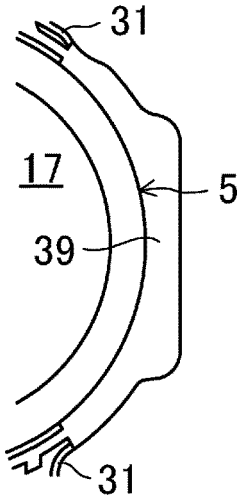
FIG. 7C shows, on an enlarged scale, the portion VIIc in FIG. 1 with the water jacket spacer attached.

FIGS. 7A-7C show, on an enlarged scale, portions of FIG. 1 with the water jacket spacer 25 attached. Specifically, FIG. 7A shows the portion VIIa, FIG. 7B shows the portion VIIb, and FIG. 7C shows the portion VIIc. As shown in FIG. 7A, the gap corresponding to the each inter-cylinder bore wall 9 is closed with the associated sealing member 35 arranged therein. As shown in FIGS. 7B and 7C, the gaps corresponding to the cylinders 5 at the ends in the engine front-rear direction are closed respectively with the arch-shaped sealing members 37 and 39 arranged therein. Note that the sealing member 35 is omitted from FIG. 2.

As shown in FIGS. 4, 5, and 6A, the flange section 29 extends along the entire periphery of the upper end of the jacket spacer lower section 27. A portion of the flange section 29 that corresponds to the cooling water-introducing passage 23 projects outwardly in conformity with the shape of the cooling water-introducing passage 23.

The outer peripheral end of the portions of the flange section 29 that correspond to the inter-cylinder bore walls 9, 9, . . . curves more gradually than the portions of the jacket spacer lower section that correspond to the inter-cylinder bore walls 9, 9, . . . .

The flange section 29 has substantially the same width as that of the cylinder block water jacket 13 over the entire periphery of the cylinder block water jacket 13. However, a portion of the flange section 29 which is located toward the engine front with respect to the cylinder 5 closest to the front of the engine forms a cooling water-discharging section 41 through which the cooling water is discharged to a jacket body 55 (i.e. a cylinder head water jacket) which is formed inside the cylinder head 7 (and which will be detailed later).

As shown in FIG. 6A, in the flange section 29, an intermediated section between the cooling water-discharging section 41 and the portion corresponding to the cooling water-introducing portion 23 (hereinafter referred to as the intermediate section) has a smaller width than any other portion of the flange section 29.

The jacket spacer upper section 31 extends along the outer peripheral end of the flange section 29. Likewise the jacket spacer lower section 27, the jacket spacer upper section 31 is in a substantially oval cylinder shape oriented in the engine front-rear direction, and has, in its portions corresponding to the inter-cylinder bore walls 9, 9, . . . , constrictions in conformity with the shapes of the inter-cylinder bore walls 9, 9, . . . , in a top view.

In an exhaust side portion of the jacket spacer upper section 31, a portion corresponding to the cooling water-introducing passage 23 has a rectangular opening 43, as shown in FIGS. 4 and 6B. The opening 43 is formed to introduce the cooling water that has been introduced from the cooling water-introducing passage 23 to the space present inward relative to the jacket spacer upper section 31.

As shown in FIGS. 2 and 3, the jacket spacer upper section 31 is spaced from the outer peripheral surface of each cylinder 5 and is close to the cylinder block outer peripheral wall 21. Consequently, a space having a large width is formed between the jacket spacer upper section 31 and the cylinder 5, 5, . . . . The cooling water introduced from the opening 43 is circulated through this space. That is to say, this space serves as the cooling water passage 45 (i.e., a coolant passage) through which the cooling water introduced from the opening 43 is circulated from the exhaust side to the intake side, around the upper portions of the cylinder liners 19, 19, . . . .

The upper end of the jacket spacer upper section 31 is at a constant height. As shown in FIG. 6B, a portion of the exhaust side portion of the jacket spacer upper section 31 that corresponds to the cylinder 5 closest to the front of the engine has a constant height dimension, whereas the rest of the exhaust side portion decreases in height dimension from the portion toward the rear of the engine. As shown in FIG. 6C, an intake side portion of the jacket spacer upper section 31 decreases in height dimension toward the front of the engine.

A portion of the jacket spacer upper section 31 that corresponds to the intermediate section of the flange section 29 is close to the outer peripheral surface of the cylinder 5 closest to the front of the engine. Therefore, a portion of the cooling water passage 45 that corresponds to the intermediate section is narrower than any other portion of the cooling water passage 45. Consequently, this portion functions as a cooling water-restricting section 47 which restricts a flow of cooling water. The cooling water that has flowed from the opening 43 into the cooling water passage 45 branches into a flow toward the front of the engine and a flow toward the rear of the engine. Since the cooling water-restricting section 47 restricts the flow toward the front of the engine, the major portion of the cooling water that has entered the cooling water passage 45 flows toward the rear of the engine.

The water jacket spacer 25 that is comprised of the jacket spacer lower section 27 and the jacket spacer upper section 31 is arranged to surround substantially the entire periphery of the portions of the four cylinder liners 19, 19, . . . that correspond to the cylinder block water jacket 13. Specifically, as shown in FIGS. 2, 3, 6B, and 6C, the water jacket spacer 25 is supported by multiple projections arranged on the lower end of the jacket spacer lower section 27 such that the gaps are formed in the cylinder block water jacket 13, and has the opening 43 through which the cooling water is introduced. As viewed in the direction in which the pistons reciprocate, the water jacket spacer 25 surrounds the substantially the entire periphery of the portions of the four cylinder liners 19, 19, . . . that correspond to the cylinder block water jacket 13. Note that although the cooling water enters the gap between the jacket spacer lower section 27 and the outer peripheral surface of each cylinders 5, the gap between the jacket spacer lower section 27 and the cylinder block outer peripheral wall 21, and the gap between the jacket spacer upper section 31 and the cylinder block outer peripheral wall 21, the cooling water in these gaps hardly flows, and has almost no influence on the cooling performance.

Figure 8:
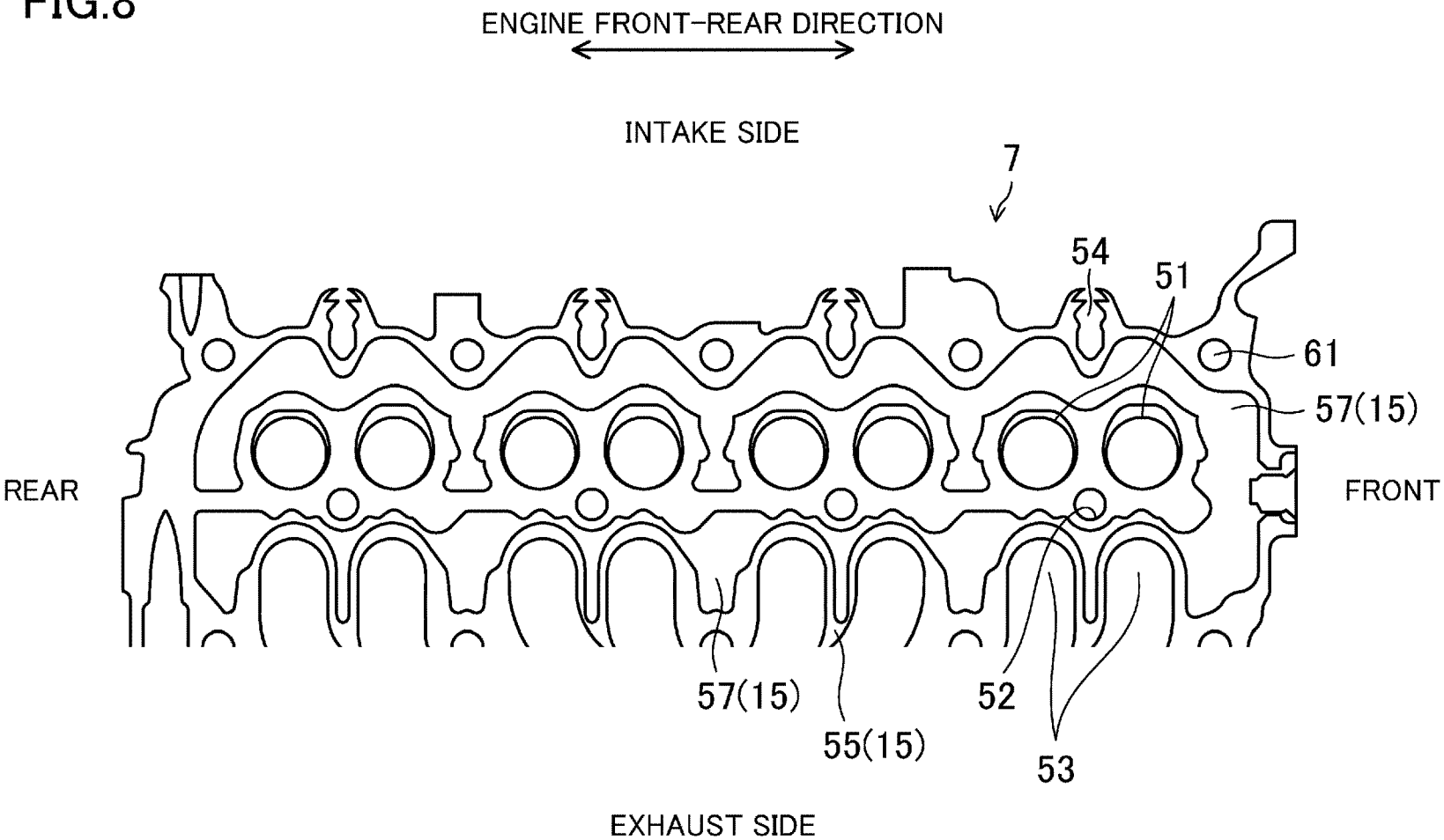
FIG. 8 is a cross-sectional view taken along the plane VIII-VIII in FIG. 3.

The cylinder head 7 is comprised of a block member which is in a substantially rectangular parallelepiped shape. Portions of the lower surface of the cylinder head 7 that correspond to the cylinder bores 17 function as the ceilings of combustion chambers 49. FIG. 8 is a cross section taken along the plane VIII-VIII in FIG. 3. In an intake side portion of each ceiling, a pair of intake ports 51 and 51 is formed in the engine front-rear direction with a spacing interposed therebetween. In an exhaust side portion of each ceiling, a pair of exhaust ports 53 and 53 is formed in the engine front-rear direction with a spacing interposed therebetween. A plug hole 52 is formed between each pair of the intake ports 51 and 51 and each pair of the exhaust ports 53 and 53, and an injector hole 54 is formed toward the intake side relative to each plug hole 52.

As shown in FIGS. 2 and 3, a cylinder head water jacket 15 is comprised of a jacket body 55 which surrounds the combustion chambers 49 of the cylinders 5, and an exhaust-side jacket 57 which is positioned opposite to the combustion chambers 49 with respect to the exhaust ports 53 of the cylinders 5.

The jacket body 55 extends entirely in the cylinder head 7 in the engine front-rear direction such that the jacket body 55 encloses the outer peripheries of the intake and exhaust ports 51 and 53 and the plug holes 52 in the surrounding vicinity of the combustion chambers 49 of the cylinders 5. Further, the jacket body 55 has holes formed in its both end portions in the engine front-rear direction, and communicates, via these holes, with both end portions in the engine front-rear direction of the exhaust-side jacket 57. This configuration allows cooling water flowing in the jacket body 55 to sequentially flow in the exhaust-side jacket 57.

As shown in FIGS. 2 and 3, a gasket 59 is arranged on the lower surface of the cylinder head 7 such that the gasket 59 covers the jacket body 55. Bolt insertion holes 61, 61, . . . which correspond to the bolt holes 11, 11, . . . formed in the cylinder block 3 are formed in this lower surface.

As shown in FIG. 2, portions of the gasket 59 that correspond to the inter-cylinder bore walls 9, 9, . . . are penetrated by communication holes 63, 63, . . . through which the cylinder block water jacket 13 communicates with the jacket body 55. A portion of the gasket 59 that corresponds to the front end of the cylinder block water jacket 13 is penetrated by a communication passage (not shown) through which the cylinder block water jacket 13 communicates with the jacket body 55.

Next, how the cooling water sent from the water pump flows will be described specifically. The cooling water sent from the water pump flows to the cooling water-introducing passage 23, leaves the cooling water-introducing passage 23 to pass through the opening 43 formed in the water jacket spacer 25, and is introduced into the cooling water passage 45.

The cooling water introduced into the cooling water passage 45 hits the outer peripheral surface of the cylinder 5 closest to the front of the engine, and consequently, branches into the flow toward the front of the engine and the flow toward the rear of the engine. As described above, the cooling water-introducing passage 23, which is tilted toward the rear of the engine as decreasing distance to the cylinder 5, directs the cooling water introduced from the cooling water-introducing passage 23 to the rear of the engine. As a result, the major portion of the cooling water introduced into the exhaust side portion of the cooling water passage 45 flows to the rear of the engine, and the rest of the cooling water flows to the front of the engine.

The flow of the cooling water toward the front of the engine is restricted by the cooling water-restricting section 47, and consequently, has a smaller flow rate than the cooling water flow toward the rear of the engine. The cooling water that has passed through the cooling water-restricting section 47 reaches the cooling water-discharging section 41, and enters the jacket body 55 of the cylinder head 7 through the communication passage formed in the gasket 59. Note that at this time, the sealing member 39 pressed in the gap between the portion of the water jacket spacer 25 that corresponds to the cooling water-discharging section 41 and the cylinder 5 closest to the front of the engine prevents the cooling water from leaking through this gap.

On the other hand, the cooling water flowing toward the rear of the engine circulates through the exhaust side portion of the cooling water passage 45. In the course of this circulation, because of the gradual decrease in the height of the cooling water passage 45, the cross-sectional area of the flow passage decreases gradually. Therefore, the cooling water is made to continue flowing at a predetermined speed. In the course of this circulation, part of the cooling water flows toward the inter-cylinder bore walls 9, 9, . . . . The sealing members 35 pressed in the gaps between the water jacket spacer 25 and the inter-cylinder bore walls 9, 9, . . . prevent the cooling water from leaking from these gaps.

The cooling water that has passed through the exhaust side portion of the cooling water passage 45 flows around the outer periphery of the cylinder 5 closest to the rear of the engine. At this time, the sealing member 37 pressed in the gap between the water jacket spacer 25 and this cylinder 5 prevents the cooling water from leaking from this gap.

The cooling water that has flowed around the outer periphery of the cylinder closest to the rear of the engine flows through the intake side portion of the cooling water passage 45 toward the front of the engine. At this time, the force of the cooling water flow has decreased due to the long distance from the cooling water-introducing passage 23. However, because of the gradual decrease in the height of the cooling water passage 45 toward the front of the engine, the cross-sectional area of the flow passage decreases gradually. Therefore, the cooling water is made to continue flowing at a predetermined speed.

The cooling water that has passed through the intake side portion of the cooling water passage 45 flows around the cylinder 5 closest to the front of the engine. The cooling water then reaches to cooling water-discharging section 41, passes through the communication passage, and enters the jacket body 55 of the cylinder head 7. Note that in the course of the circulation through the cooling water passage 45, the cooling water flows into the jacket body 55 of the cylinder head 7 through the communication holes 63, 63, . . . formed in the gasket 59.

(Measurement of Wall Temperature of Cylinder Liner)

The inventors measured the wall temperatures of points of the cylinder liner 19 along its height. Specifically, the wall temperatures of one of the cylinder liners 19, 19, . . . were measured along its height in a state where the water pump was sending cooling water to the cylinder block water jacket 13, and the engine 1 was in operation. The measurement was conducted under the following three conditions: (a) where the water jacket spacer 25 according to this embodiment was arranged in the cylinder block water jacket 13; (b) where no water jacket spacer was arranged in the cylinder block water jacket 13; and (c) where a conventional water jacket spacer was arranged in the cylinder block water jacket 13. Note that the conventional water jacket spacer had such a shape that its entirety was close to the cylinder liner 19, 19, . . . and spaced from the cylinder block outer peripheral wall 21.

Figure 9:
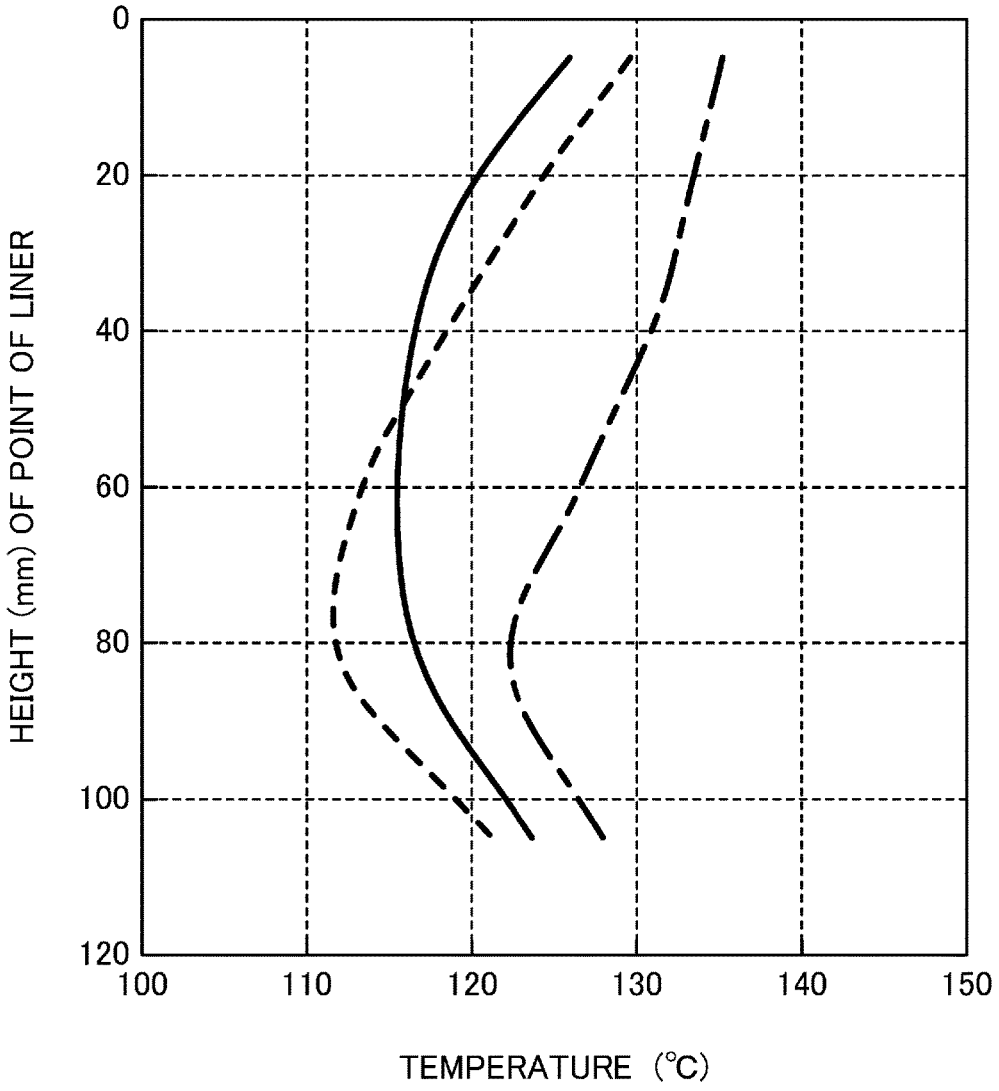
FIG. 9 is a graph showing temperature distribution of a cylinder liner.

FIG. 9 is a graph showing the results of the measurement. The vertical and transverse axes show the height of the measurement point and the wall temperature of the cylinder liner 19, respectively. The solid line represents the measurement result under the condition (a), the broken line represents the measurement result under the condition (b), and the dash-dot line represents the measurement result under the condition (c).

As can be seen from FIG. 9, under the condition (b) where no water jacket spacer was arranged, the wall temperature at the upper end of the cylinder liner 19 reached about 130° C. whereas the wall temperature at the lower end was about 112° C., and the temperature difference was about 18° C. Under the condition (c) where the conventional water jacket spacer was arranged, the wall temperatures, as a whole, shifted to a higher temperature range. Specifically, the wall temperature at the upper end of the cylinder liner 19 reached about 135° C. whereas the wall temperature at the lower end was about 122° C., and the temperature difference was about 13° C.

In contrast to these, under the condition (a) where the water jacket spacer 25 of this embodiment was arranged, the wall temperature at the upper end of the cylinder liner 19 was about 130° C., which was lower by as much as about 5° C. than the wall temperature of the case of the conventional spacer, whereas the wall temperature from the middle portion to the lower end was about 115° C., and the temperature difference was about 15° C. Thus, the results show that the water jacket spacer 25 according to this embodiment is capable of keeping the temperature of the entire cylinder liner 19 lower, and reducing the temperature difference along the height of the cylinder liner 19.

Advantages of Exemplary Embodiment According to the exemplary embodiment described above, the cooling water passage 45 is formed between the jacket spacer upper section 31 and the outer periphery of the upper portions of the cylinder liners 19, 19, . . . . Therefore, cooling water flowing through the cooling water passage 45 is not allowed to come into contact with the cylinder block outer peripheral wall 21. In addition, since the jacket spacer upper section 31 is close to the cylinder block outer peripheral wall 21, the cooling water flowing through the cooling water passage 45 is thermally insulated by the water jacket spacer 25. This may hinder the heat of the cylinder liners 19, 19, . . . from being dissipated to the cylinder block outer peripheral wall 21 via the cooling water flowing through the cooling water passage 45. Further, the jacket spacer lower section 27 is close to each cylinder liner 19, and the middle portion of each cylinder liner 19 is thermally insulated by the water jacket spacer 25, which reduces cooling of the middle portion of each cylinder liner 19. As a result the foregoing, the temperature of each cylinder liner 19 may be increased within a short time, and uniform temperature distribution may be achieved. Consequently, the sliding resistance of the pistons may be reduced, and fuel efficiency may be improved. Further, cooling of the upper portion of the cylinder liner 19 may be endured. Furthermore, since the cooling water flows through only the upper portion of the cylinder block water jacket 13, the amount of cooling water may be reduced, which may lead to a decrease in the load on the water pump that sends the cooling water to the cylinder block water jacket 13. As a result, the warm-up of the engine 1 may be facilitated.

According to this embodiment, the cooling water passage 45 is formed by spacing the jacket spacer upper section 31 from the outer periphery of the upper portions of the cylinder liners 19, 19, . . . . This may enable the formation of the cooling water passage 45 without changing the shape of the outer periphery of the upper portion of each cylinder liner 19.

According to the embodiment above described, taking into consideration manufacturing errors and mountability, the resin water jacket spacer 25 is molded such that the large gaps are provided between the spacer 25 and the inter-cylinder bore walls 9, 9, . . . . The sealing members 35 provided so as to close these gaps may hinder the cooling water flowing through the cooling water passage 45 from leaking outside from the cooling water passage 45 via the gaps.

Further, according to the embodiment described above, since the cooling water is circulated from the exhaust side portion having a relatively high temperature, the cylinder liner 19 of each cylinder 5 may be appropriately cooled.

Furthermore, according to the embodiment described above, cooling water introduced from the cooling water-introducing passage 23 enters the cooling water passage 45 through the opening 43 of the water jacket spacer 25, and flows to the front of the engine and to the rear of the engine. The portion of the cooling water flowing to the front of the engine is restricted by the cooling water-restricting section 47. Specifically, the cooling water that flows from the opening 43 to the cylinder head water jacket 15 through the cooling water-discharging section 41 is restricted by the cooling water-restricting section 47. Therefore, the major portion of the cooling water that has entered the cooling water passage 45 from the opening 43 may be made to flow through the exhaust side portion of the cooling water passage 45, and may be reliably circulated through the cooling water passage 45. Then, the cooling water is made to flow into the cylinder head water jacket 15.

INDUSTRIAL APPLICABILITY

As described above, the technique disclosed herein is useful for reducing heat dissipation to a cylinder block outer peripheral wall, achieving fast and uniform heating of a cylinder liner, and ensuring cooling of an upper portion of the cylinder liner.

DESCRIPTION OF REFERENCE CHARACTERS (1) Engine
(3) Cylinder Block
(5) Cylinder
(7) Cylinder Head
(9) Inter-cylinder Bore Wall
(19) Cylinder Liner
(13) Cylinder Block Water Jacket (Water Jacket)
(15) Cylinder Head Water Jacket
(21) Cylinder Block Outer Peripheral Wall
(23) Cooling Water-introducing Passage (Coolant-introducing Section)
(25) Water Jacket Spacer
(27) Jacket Spacer Lower Section (Lower Section of Water Jacket Spacer)
(31) Jacket Spacer Upper Section (Upper Section of Water Jacket Spacer)
(35) Sealing Member
(41) Cooling Water-discharging Section (Coolant-discharging Section)
(43) Opening
(45) Cooling Water Passage (Coolant Passage)
(47) Cooling Water-restricting Section (Coolant-restricting Section)

The invention claimed is:

1. An engine cooling structure in which a water jacket surrounds cylinder liners of a cylinder block forming part of an engine, a coolant-introducing section through which a coolant is introduced into the water jacket is formed in a cylinder block outer peripheral wall constituting an outer periphery of the water jacket, and a water jacket spacer is arranged in the water jacket, wherein the water jacket spacer is arranged to surround substantially an entire periphery of a portion of the cylinder liners which correspond to the water jacket, the water jacket spacer has a lower section, a flange section, and an upper section, the lower section of the water jacket spacer is positioned close to the cylinder liner than the upper section, the flange section projects outwardly from an upper end of the lower section to a lower end of the upper section, and the flange section extends along a periphery of the upper end of the lower section, along at least two cylinder liners, the upper section extends upwardly from an outer peripheral end of the flange section, an opening through which the coolant introduced from the coolant-introducing section to an inward side relative to the water jacket spacer is formed penetrating in a protrusion portion, the protrusion portion formed in the upper section of the water jacket spacer which protrudes and corresponds to the coolant-introducing section, the opening is formed in an end portion of the water jacket spacer in a direction in which the cylinders are aligned, a coolant passage through which the coolant introduced from the opening is circulated around an outer periphery of an upper portion of the cylinder liner is formed between the upper section of the water jacket spacer and the outer periphery of the upper portion of the cylinder liner, and the position of the flange section in the height direction of the water jacket spacer rises with distance over at least part of the distance from the opening toward an end portion of the coolant circulating direction in the coolant passage.

2. The engine cooling structure of claim 1, wherein the coolant passage is formed by spacing the upper section of the water jacket spacer from the outer periphery of the upper portion of the cylinder liner.

3. The engine cooling structure of claim 1, wherein the engine is configured as a multi-cylinder engine including a plurality of cylinders, the water jacket spacer is made of resin, and seal members are provided between inter-cylinder bore walls of the cylinder block and portions of the water jacket spacer which correspond to the inter-cylinder bore walls.

4. The engine cooling structure of claim 1, wherein the opening is formed in an end portion of the water jacket spacer in a direction in which the cylinders are aligned, the coolant passage is formed such that the coolant introduced from the opening is circulated from an exhaust side portion of the coolant passage to an intake side portion of the coolant passage.

5. The engine cooling structure of claim 4, wherein in a cylinder head which constitutes the engine together with the cylinder block, a cylinder head water jacket through which the coolant from the water jacket of the cylinder block flows is formed, a coolant-discharging section through which the coolant that has been circulated through the coolant passage is discharged to the cylinder head water jacket is formed in an end of the water jacket spacer in the direction in which the cylinders are aligned, and a coolant-restricting section which restricts a flow of the coolant that has been introduced from the opening is formed between the coolant-discharging section and the opening in the water jacket spacer.

6. The engine cooling structure of claim 1, wherein a lower end of the protrusion portion is partially formed by the flange section.

7. An engine cooling structure in which a water jacket surrounds cylinder liners of a cylinder block forming part of an engine, a coolant-introducing section through which a coolant is introduced into the water jacket is formed in a cylinder block outer peripheral wall constituting an outer periphery of the water jacket, and a water jacket spacer is arranged in the water jacket, wherein the water jacket spacer is arranged to surround substantially an entire periphery of a portion of the cylinder liners which correspond to the water jacket, the water jacket spacer has a lower section, a flange section, and an upper section, of the water jacket spacer is positioned close to the cylinder liner than the upper section, the flange section projects outwardly from an upper end of the lower section to a lower end of the upper section, and the flange section extends along an entire periphery of the upper end of the lower section, the upper section extends upwardly from an outer peripheral end of the flange section, an opening through which the coolant introduced from the coolant-introducing section to an inward side relative to the water jacket spacer is formed in a portion of the water jacket spacer which corresponds to the coolant-introducing section, an upper section of the water jacket spacer is positioned close to the cylinder block outer peripheral wall, the opening is formed in an end portion of the water jacket spacer in a direction in which the cylinders are aligned, a coolant passage through which the coolant introduced from the opening is circulated around an outer periphery of an upper portion of the cylinder liner is formed between the upper section of the water jacket spacer and the outer periphery of the upper portion of the cylinder liner, the coolant passage is formed such that the coolant introduced from the opening is circulated from an exhaust side portion of the coolant passage to an intake side portion of the coolant passage, in a cylinder head which constitutes the engine together with the cylinder block, a cylinder head water jacket through which the coolant from the water jacket of the cylinder block flows is formed, the cylinder head water jacket is provided so as to connect the exhaust side and the intake side of the coolant passage which corresponds to an inter-cylinder bore wall, the position of the flange section in the height direction of the water jacket spacer rises with distance over at least part of the distance from the exhaust side toward the intake side.

8. The engine cooling structure of claim 7, wherein the cylinder head water jacket comprises a jacket body that surrounds a combustion chamber of a cylinder, and a gasket arranged on the lower surface of the cylinder head that covers the jacket body, wherein portions of the gasket that correspond to the inter-cylinder bore wall are penetrated by communication holes through which the cylinder block water jacket communicates with the jacket body.

9. The engine cooling structure of claim 1, wherein the flange section extends along an entire periphery of the upper end of the lower section.

10. The engine cooling structure of claim 1, wherein the upper section extends upwardly from an entire outer peripheral end of the flange section.

11. The engine cooling structure of claim 1, wherein the position of the flange section in the height direction of the water jacket spacer continuously rises over a distance that corresponds to more than two cylinder liners.

12. The engine cooling structure of claim 1, wherein the coolant passage through which the coolant introduced from the opening is passed through an another end portion of the coolant passage opposite to the opening in the direction the cylinder liners are aligned.

13. The engine cooling structure of claim 1, wherein the flange section rises in the height direction of the water jacket spacer at an incline.

14. The engine cooling structure of claim 7, wherein the flange section rises in the height direction of the water jacket spacer at an incline.

15. An engine cooling structure in which a water jacket surrounds at least one cylinder liner of a cylinder block forming part of an engine, a coolant-introducing section through which a coolant is introduced into the water jacket is formed in a cylinder block outer peripheral wall constituting an outer periphery of the water jacket, and a water jacket spacer is arranged in the water jacket, wherein the water jacket spacer is arranged to surround substantially an entire periphery of a portion of the cylinder liner which corresponds to the water jacket, the water jacket spacer has a lower section, a flange section, and an upper section, the lower section of the water jacket spacer is positioned close to the cylinder liner than the upper section, the flange section projects outwardly from an upper end of the lower section to a lower end of the upper section, and the flange section extends along a periphery of the upper end of the lower section, the upper section extends upwardly from an outer peripheral end of the flange section, the upper section directly faces the cylinder liner, an opening through which the coolant introduced from the coolant-introducing section to an inward side relative to the water jacket spacer is formed penetrating in a protrusion portion, the protrusion portion formed in the upper section of the water jacket spacer which protrudes and corresponds to the coolant-introducing section, the opening is formed in an end portion of the water jacket spacer in a direction in which the cylinders are aligned, a coolant passage through which the coolant introduced from the opening is circulated around an outer periphery of an upper portion of the cylinder liner is formed between the upper section of the water jacket spacer and the outer periphery of the upper portion of the cylinder liner, and the position of the flange section in the height direction of the water jacket spacer rises with distance over at least part of the distance from the opening toward an end portion of the coolant circulating direction in the coolant passage.

* * * * *